US006763823B1

(12) United States Patent
Ikehara

(10) Patent No.: US 6,763,823 B1
(45) Date of Patent: Jul. 20, 2004

(54) MACHINING METHOD NOT CAUSING ANY DAMAGE TO MAJOR CUT SURFACES OF CUT OBJECTS

(75) Inventor: Masahiro Ikehara, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/522,397

(22) Filed: Mar. 9, 2000

(30) Foreign Application Priority Data

Mar. 9, 1999 (JP) ..... 11-061352
Jan. 18, 2000 (JP) ..... 2000-008948

(51) Int. Cl.[7] ..... B28D 1/08
(52) U.S. Cl. ..... 125/16.02; 125/21
(58) Field of Search ..... 125/21, 16.01, 125/16.02, 70; 83/746

(56) References Cited

U.S. PATENT DOCUMENTS 5,715,806 A * 2/1998 Tonegawa et al. ..... 125/16.02
6,135,103 A * 10/2000 Katamachi ..... 125/21
6,178,962 B1 * 1/2001 Ohashi et al. ..... 125/16.01
6,234,159 B1 * 5/2001 Egglhuber
6,381,830 B1 * 5/2002 Chikuba et al. ..... 29/557

FOREIGN PATENT DOCUMENTS

JP A8-7272 1/1996
JP A10-44141 2/1998

* cited by examiner

*Primary Examiner*—Timothy V. Eley
(74) *Attorney, Agent, or Firm*—Birch, Stewart, Kolasch & Birch, LLP

(57) ABSTRACT

An ingot is placed below parallel wires of a multiwire saw, and the wires are driven to run. The ingot is moved upward and cut by the wires to obtain wafers. The wires are displaced toward one side of cut surfaces of the wafers. By lowering the wafers as the wires remains displaced toward the one side of cut surfaces of the wafers, the wires are pulled out of the wafers without contacting the other side cut surfaces of the wafers. Thus, the multiwire saw does not cause any damage to major surfaces of the wafers and is used many times without cutting the wires.

4 Claims, 2 Drawing Sheets

MACHINING METHOD NOT CAUSING ANY DAMAGE TO MAJOR CUT SURFACES OF CUT OBJECTS

BACKGROUND OF THE INVENTION

The present invention relates to a machining method using a multiwire saw having a plurality of parallel wires. More specifically, the invention relates to a machining method using a multiwire saw, by which when only one of front and rear surfaces of a wafer or the like is required to be good at machining accuracy, continuous machining process is achieved with high efficiency while maintaining the machining accuracy of the one surface.

Conventionally, the multiwire saw has advantages that the cutting process is achieved with less cutting margins as compared with ID saws (Inside Diameter saws) and that the multiwire saw is superior to the ID saws in machining ability because of capability of carrying out a plurality of cuttings at the same time.

On the other hand, the multiwire saw has a defect of poorer machining accuracy as compared with the ID saws. In particular, because cutting process with the multiwire saw is performed with less cutting margins, the distance between cut objects and the wires is so narrow that the wires may come into contact with cut surfaces of the cut objects during the withdrawal of the wires from the cut objects. This contact may cause the cut surfaces to be flawed, which accounts for a defect of the multiwire saw.

In particular, in the case of a narrow distance between the wires, as shown in FIG. 4A, cut objects 11 at cutting start ends 11*a* may contact each other due to deformation of cut objects after cutting a workpiece on a mount 13. In such a case, even if a cleaning solution 15 is sprayed from above the cutting start ends 11*a*, abrasive grains 14 remain between the cut objects 11 without being cleaned away. This accounts for a disadvantage that the cut surfaces of the cut objects 11 may be flawed by the wires 12 or by the abrasive grains 14 remaining between the cut objects 11 when wires 12 are withdrawn from cut objects 11.

In the prior art, therefore, it has been practiced to take a method that the wires are cut upon completion of cutting of the workpiece in order to prevent the cut surface from being flawed when the multiwire saw is separated from the cut objects.

However, with this method in which the wires are pulled out from the cut object by cutting the wires of the multiwire saw, the wires need to be replaced with new ones each time the workpiece has been cut, which may cause cost of wires to be increased and cause operating cycle time of the multiwire saw to be prolonged.

Further, because the wires abruptly lose the tension at the time of cutting the wires, ends of the wires may pop into contact with the cut surfaces of the cut objects in pulling our the wires even with careful work, which may cause the cut surfaces to be flawed.

SUMMARY OF THE INVENTION

An object of the present invention is to provide a machining method using a multiwire saw which does not cause any damage to major cut surfaces of cut objects and which can be used a plurality of times without cutting wires of a multiwire saw.

In order to achieve the above object, according to the present invention, there is provided a machining method using a multiwire saw for obtaining a plurality of cut objects by cutting a fixed workpiece with a multiwire saw having a plurality of parallel wires, comprising: a step of cutting the workpiece with the parallel wires of the multiwire saw under a sprinkle of abrasive solution including abrasive grains, thereby obtaining the cut objects; a step of relatively displacing the wires toward one side of cut surfaces of the cut objects; and a step of separating the multiwire saw from the cut objects as the wires remains displaced toward the one side of the cut surfaces of the cut objects.

With this constitution, the fixed workpiece is cut with the multiwire saw having the plurality of parallel wires, by which a plurality of cut objects are obtained. Thereafter, the plurality of wires are displaced toward one side of cut surfaces of the cut objects, or the workpiece is displaced, and then the multiwire saw is separated from the plurality of cut objects. Since the multiwire saw is pulled out after displacing the plurality of wires or after displacing the workpiece toward one side of cut surfaces of the cut objects, the multiwire saw is separated from the plurality of cut objects without causing the wires to contact the cut surfaces opposing the one side of cut surfaces of the cut objects. Therefore, even if the one side cut surfaces of the cut objects are damaged, the other side cut surfaces are not damaged. Further, the wires of the multiwire saw are not cut each time the workpiece has been cut, as has been involved in the prior art, so that the operating cycle time is shortened and the cost is reduced.

In an embodiment of the present invention, a quantity L by which the wires of the multiwire saw are displaced toward the one side of the cut surfaces of the cut objects meets the following condition: $L \geqq (w-d)/2$ where w is a cutting margin and d is a wire diameter.

With this constitution, the wires of the multiwire saw never damage the cut surfaces opposing the one side of the cut surfaces by contacting the one side cut surfaces of the cut objects. Also the wires are separated from the cut objects without causing plastic deformation of the cut objects.

In an embodiment of the present invention, the abrasive grains have a grain size of #2000 or more according to JIS-R6001 so that cutting process damage on the workpiece is reduced.

With this constitution, since abrasive grains having a small grain size of #2000 or more, damage remaining in the cut workpiece is reduced, and the cutting margin is also reduced.

In an embodiment of the present invention, the abrasive grains have a grain size of #3000 to #6000 according to JIS-R6001.

With this constitution, since the abrasive grains have a grain size of #3000 to #6000, damage remaining in the cut workpiece is reduced, and the cutting margin is also reduced. Moreover, the workpiece is cut without lowering the machining efficiency.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Hereinbelow, the present invention is described in detail by way of embodiments thereof illustrated in the accompanying drawings.

Figure 1:
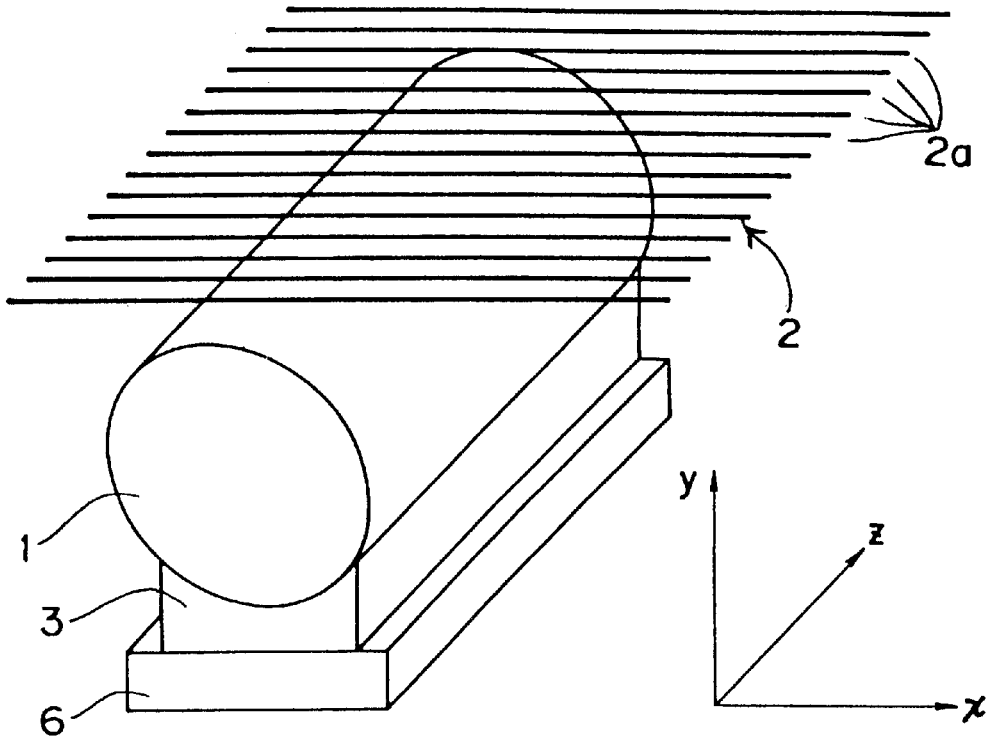
FIG. 1 is a perspective view of a multiwire saw and an ingot before cutting according to an embodiment of the invention.

FIG. 1 is a perspective view of an ingot 1 as a workpiece before cutting, and a multiwire saw 2. The ingot 1 is, for example, a cylindrical-shaped compound semiconductor single crystal ingot having a zinc-blende structure grown in <111> bearing by LEC (Liquid Encapsulated Czochralski) technique. The multiwire saw 2 has a plurality of wires 2*a* arranged in parallel on the same plane. The ingot 1 is stuck on a mount 3 such as a ceramic base and cut by the multiwire saw 2 under a sprinkle of an abrasive solution including abrasive grains having grain size of #2000 or more, preferably #3000–#6000, according to JIS(Japanese Industrial Standard)-R6001. Even after the ingot 1 is completely cut to be formed into wafers 1*a* as cut objects, the wafers 1*a* are fixed on the mount 3. This mount 3 is fitted onto a stage 6, and the stage 6 has a mechanism (not shown) which is slidable in directions of y-axis and z-axis. The ingot 1, as shown in FIG. 1, is positioned below the multiwire saw 2 by sliding the stage 6 in the positive direction of z-axis. Also, the ingot 1 is moved up by sliding the stage 6 in the positive direction of y-axis and cut by the running multiwire saw 2. Further, this stage 6 is equipped with a mechanism (not shown) that is allowed to finely adjust the following angles θ and ϕ of the ingot 1, thus capable of cutting out a desired crystal plane, e.g. {111} plane, from the ingot 1. When the x-axis, y-axis and z-axis are perpendicular to one another and the y-axis is perpendicular to a plane including the wires 2*a*, the angle θ is an angle formed between the z-axis and a line which results from projection of the <111> bearing of the set crystals onto the zx plane, while the angle ϕ is an angle formed between the z-axis and a line which results from projection of the <111> bearing onto the yz plane.

The cutting of the ingot 1 by the multiwire saw 2 and pullout of the wires 2*a* are carried out as follows.

Figure 2A:
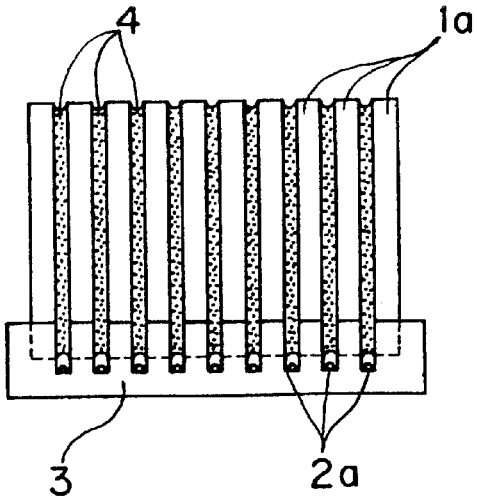
FIG. 2A is a front view of a wafer after cutting and a multiwire saw after cutting according to an embodiment of the invention.
Figure 2B:
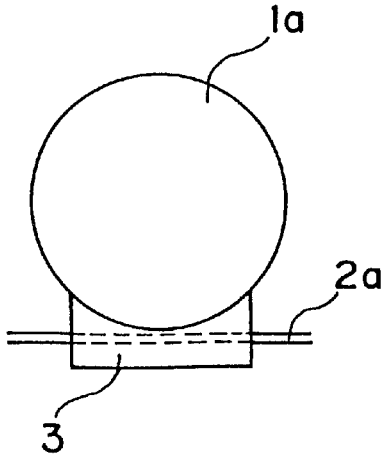
FIG. 2B is a side view of FIG. 2A.

First, after the ingot 1 is stuck on and fixed to the mount 3, the stage 6 is moved in the positive direction of z-axis, so that the ingot 1 is located below the wires 2*a* as shown in FIG. 1. Next, by actuating the multiwire saw 2, the wires 2*a* are driven in the positive or negative direction of x-axis. Then, by moving the stage 6 in the positive direction of y-axis, the ingot 1 is cut by the wires 2*a*, so that the wafers 1*a* are formed as shown in FIGS. 2A and 2B. These wafers 1*a* are stood side by side as they remain fixed to the mount 3. Because of a narrow distance between the wafers 1*a*, abrasive grains 4 remain between the wafers 1*a*. These abrasive grains 4 are removed by spraying a cleaning solution from above or beside the wafers 1*a*.

Figure 3:
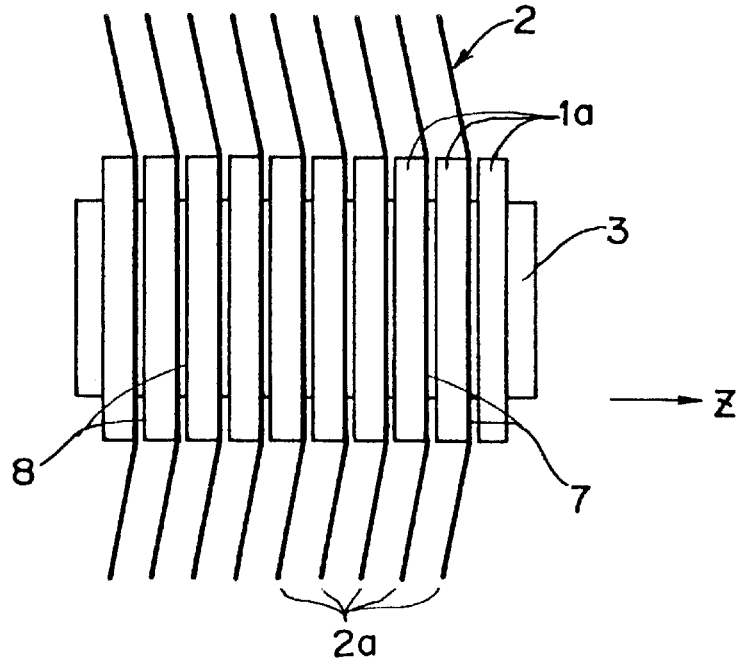
FIG. 3 is a plan view of a wafer after cutting and a multiwire saw displaced after the cutting according to an embodiment of the invention.
Figure 4A:
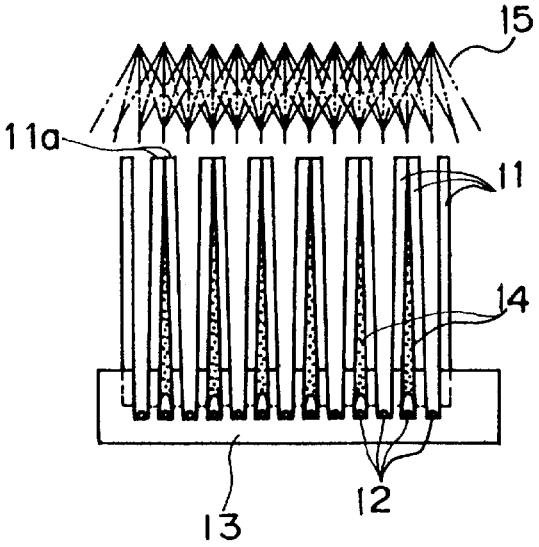
Fig. 4A PRIOR ART
FIG. 4A is a front view of a wafer and a multiwire saw after cutting according to a prior art method.
Figure 4B:
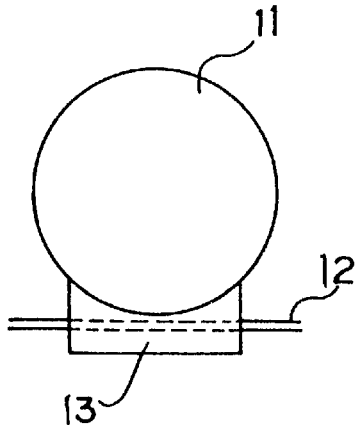
Fig. 4B PRIOR ART
FIG. 4B is a side view of FIG. 4A.

At the time when the ingot 1 is cut into the wafers 1*a*, the wires 2*a* have penetrated into the mount 3. Next, in the state that the wires 2*a* have penetrated into the mount 3 as shown in FIG. 3, the stage 6 is slid so that the mount 3 is shifted in the positive direction of z-axis, with the wires 2*a* relatively displaced toward one side of cut surfaces 7 of the wafers 1*a*. The mount 3 is shifted in the positive direction of z-axis to a shift amount L represented by the following equation:

$$L \geq (w-d)/2$$

where w is the cutting margin and d is the wire diameter.

Next, as the mount 3 remains shifted in the positive direction of z-axis, the stage 6 is moved in the negative direction of y-axis, and thereby the wires 2*a* are pulled out from the wafers 1*a*.

When the wires 2*a* are pulled out from the wafers 1*a* in this way, the wires 2*a* indeed may damage one side cut surfaces 7 of the wafers 1*a*, yet never damage the other-side cut surfaces 8 as shown in FIG. 3. That is, the wires 2*a* never damage the cut surfaces 8, i.e., {111}B planes of the wafers 1*a*.

When the wires 2*a* are pulled out from the wafers 1*a*, the wires 2*a* make contact with the cut surfaces 7, i.e., {111}A planes of the wafers 1*a*. However, since the shift amount L of the mount 3 has been set as described above, such a force as can cause the wafers 1*a* to be plastically deformed does not act on the cut surfaces 7. Also, the cut surfaces 7 is less often required to be good at surface machining accuracy as much as the cut surfaces 8 as described below, and therefore this contact of the wires 2*a* with the cut surfaces 7 never matters.

Further, the wires 2*a* of the multiwire saw 2 are not cut each time the ingot 1 is cut. Therefore, the cut surfaces are never damaged due to pops of the wires 2*a*, the operating cycle time is shortened, and the wires 2*a* do not need to be replaced, contributing to a reduction in cost.

The {111} plane of a compound semiconductor having a zinc-blende structure comprises a {111}A plane and a {111}B plane, and when cut out by a plane normal to the <111> bearing, the {111} plane necessarily results in one {111}A plane and the other {111}B plane. These planes are different in properties from each other, and so, generally, discriminated in device production. For example, when a GaP single crystal ingot grown in the <111> bearing by LEC technique is cut into wafers with a multiwire saw, epitaxial growth is commonly applied to the {111}B plane. Also, even if two cut surfaces are equivalent to each other like the {100} plane, it is not the case, generally, to demand equal machining accuracy to the two cut surfaces in device formation. For example, when a GaAs single crystal ingot grown by HB (Horizontal Bridgman) method is cut into wafers so that the {100} plane is obtained, it is often the case that an arbitrarily determined one surface is polished for use of epitaxial growth while the other plane is shipped as sliced. This is because it is not necessary for the plane that is not used for epitaxial growth that the plane be as flat as the plane used for epitaxial growth and that the cutting damage layer be removed.

As shown above, it is often the case that wafers to be cut by a multiwire saw are not required to machined at equal machining accuracy on both sides, and the present invention is particularly useful for such cases.

In addition, how much larger L should be set than (w−d)/2 depends greatly on wire tension, fragility of wafers, abrasive grain size and distance between fixed ends of wires.

Further, in this embodiment, the movement of the wires relative to the mount has been executed to a quantity of L before the start of pullout of the wires. However, if the deformation amount of wafers is larger or if the elasticity of wafers is larger, the wires may be pulled out from the wafers by displacing the mount continuously in the positive or negative direction of z-axis in such a way that the wires do not contact one side cut surfaces of the wafers, in linkage with the motion of the mount in the negative direction of y-axis.

The invention being thus described, it will be obvious that the same may be varied in many ways. Such variations are not be regarded as a departure from the sprit and scope of the invention, and all such modifications as would be obvious to one skilled in the art are intended to be included within the scope of the following claims.

What is claimed is:

1. A machining method using a multiwire saw for obtaining a plurality of cut objects by cutting a fixed workpiece with a multiwire saw having a plurality of parallel wires, comprising:

a step of cutting the workpiece with the parallel wires of the multiwire saw under a sprinkle of abrasive solution which includes abrasive grains, thereby obtaining the cut objects with each cut object having two cut surfaces;

a step of relatively displacing each one of the parallel wires toward one side of the respective two cut surfaces of each of the cut objects; and a step of separating the multiwire saw from the cut objects as each one of the parallel wires remain displaced toward solely the one side of the respective two cut surfaces of each of the cut objects.

2. The machining method using a multiwire saw according to claim 1, wherein a quantity L by which the parallel wires of the multiwire saw are displaced toward the one side of the two cut surfaces of each of the cut objects meets the following conditions:

$$L \geqq (w-d)/2$$

where w is a cutting margin and d is a wire diameter.

3. The machining method using a multiwire saw according to claim 1, wherein the abrasive grains have a grain size of #2000 or more according to JIS-R6001 so that cutting process damage on the workpiece is reduced.

4. The machining method using a multiwire saw according to claim 3, wherein the abrasive grains have a grain size of #3000 to #6000 according to JIS-R6001.

* * * * *